US012338090B2

(12) United States Patent
Flavio

(10) Patent No.: US 12,338,090 B2
(45) Date of Patent: Jun. 24, 2025

(54) SUPPORT FOR ADHESIVE TAPE

(71) Applicant: ELETTRORIOLO DI VEGGI MAURIZIO FLAVIO, Riolo Terme (IT)

(72) Inventor: Veggi Maurizio Flavio, Riolo Terme (IT)

(73) Assignee: TECHNOLOGY FOR PROPULSION AND INNOVATION S.P.A., Padua (IT)

( * ) Notice: Subject to any disclaimer, the term of this patent is extended or adjusted under 35 U.S.C. 154(b) by 358 days.

(21) Appl. No.: 17/858,626

(22) Filed: Jul. 6, 2022

(65) Prior Publication Data

US 2023/0011974 A1 Jan. 12, 2023

(30) Foreign Application Priority Data

Jul. 8, 2021 (IT) ..... 102021000017951

(51) Int. Cl.
*B65H 16/02* (2006.01)
*B65H 19/12* (2006.01)

(52) U.S. Cl.
CPC ..... *B65H 16/02* (2013.01); *B65H 19/12* (2013.01); *B65H 2301/41335* (2013.01); *B65H 2701/377* (2013.01)

(58) Field of Classification Search
CPC ..... B65H 16/005; B65H 16/02; B65H 19/12; B65H 19/123; B65H 23/06; B65H 2301/41335; B65H 2402/411; B65H 2402/413; B65H 2701/377
See application file for complete search history.

(56) References Cited

U.S. PATENT DOCUMENTS 3,125,264 A * 3/1964 English ..... B65H 35/002 225/78
6,216,978 B1 * 4/2001 Rodriguez ..... E04F 21/00 242/588.1
2011/0108588 A1 * 5/2011 Bar ..... A45F 5/02 224/162

* cited by examiner

*Primary Examiner* — Philip C Tucker
*Assistant Examiner* — Jimmy R Smith, Jr.
(74) *Attorney, Agent, or Firm* — Tutunjian & Bitetto, P.C.

(57) ABSTRACT

A Support for adhesive tape, including: a cylindrical, or substantially cylindrical, body configured to be inserted inside the tubular core of the adhesive tape; a base, associated with the cylindrical body, to which, in turn, a connecting element to an operator's garment, or to an operator's accessory, or to further parts of the operator's equipment, is associated; at least a retractable element, provided along the lateral surface of said cylindrical body, including a control suitable for selectively actuating said retractable element from a retention configuration of the adhesive tape on the cylindrical body, to a configuration of free removal of the adhesive tape from the cylindrical body, and vice versa.

8 Claims, 6 Drawing Sheets

SUPPORT FOR ADHESIVE TAPE

TECHNICAL FIELD OF THE INVENTION

The present invention concerns a support for adhesive tape.

More in detail, this invention relates to a support for adhesive tape which allows the operator to keep the adhesive tape always in a convenient, accessible and safe location during work.

DESCRIPTION OF THE PRIOR ART

In various professional fields, adhesive tape is used in the form of a cylindrical or disc-shaped reel.

A typical example of such professional fields (to be considered, however, non limiting) in which very frequent use of adhesive tape is made is that of electricians. In a typical operating situation for an electrician, such as setting up, or repairing, or modifying an electrical system, the operator needs to frequently use portions of adhesive tape, so it is advisable for them to have the aforementioned reel always close at hand.

Normally, for easier availability and accessibility, the operator will keep the adhesive tape in one of the pockets of their clothes, or place it on an easily accessible surface, or even inside a container or tool case.

However, these possible solutions are not always easy to implement, for various reasons linked, for example, to the characteristics of the specific workplace in which the operator is working.

Therefore, it can frequently happen that the operator loses the adhesive tape, or in any case experiences difficulties in finding it, and this obviously causes considerable inconvenience and delays in carrying out the work.

Or, there may be working situations in which the operator must use several adhesive tapes of different types, and therefore they must be able to choose, each time, one or the other quickly and safely.

SUMMARY OF THE INVENTION

The aim of the present invention is to improve the state of the art in the field of working equipment and the like.

Within the scope of this technical aim, an object of this invention is to provide a support for adhesive tape that makes it possible to overcome the drawbacks claimed above.

Another object of this invention is to provide a support for adhesive tape which allows the operator to use said tape, when necessary, in a quick, accurate and reliable way.

A further object of this invention is to make a support for adhesive tape available which allows the above mentioned results to be obtained with a simple and economical construction solution.

This aim and these objects are achieved by the support for adhesive tape according to the present application.

The support comprises a cylindrical, or substantially cylindrical, body configured to be inserted inside the tubular core of the adhesive tape.

According to an aspect of the invention, such support comprises a base, associated with said cylindrical body, to which, in turn, a connecting element to an operator's garment, or to an operator's accessory, or to further parts of the operator's equipment, is associated.

Furthermore, according to another aspect of the invention, this cylindrical body comprises selective constraint means of the adhesive tape, provided with a control suitable for actuating said selective constraint means from a retention configuration of the adhesive tape on the cylindrical body to a configuration of free removal of the adhesive tape from said cylindrical body, and vice versa.

Thanks to this solution, the adhesive tape can be held firmly and securely in the position established by the operator (for example, but not limited to, fastened to their belt).

Therefore, whenever the use of adhesive tape is required, the operator can simply and immediately reach for it and take it with a simple gesture, and with no risk of losing it or confusing it with other similar objects.

The present application refers to preferred and advantageous embodiments of the invention.

BRIEF DESCRIPTION OF DRAWINGS

The features of the invention will be better understood by anyone skilled in the art from the following description and accompanying drawings, provided by way of non-limiting example, in which.

DETAILED DESCRIPTION

Figure 1:
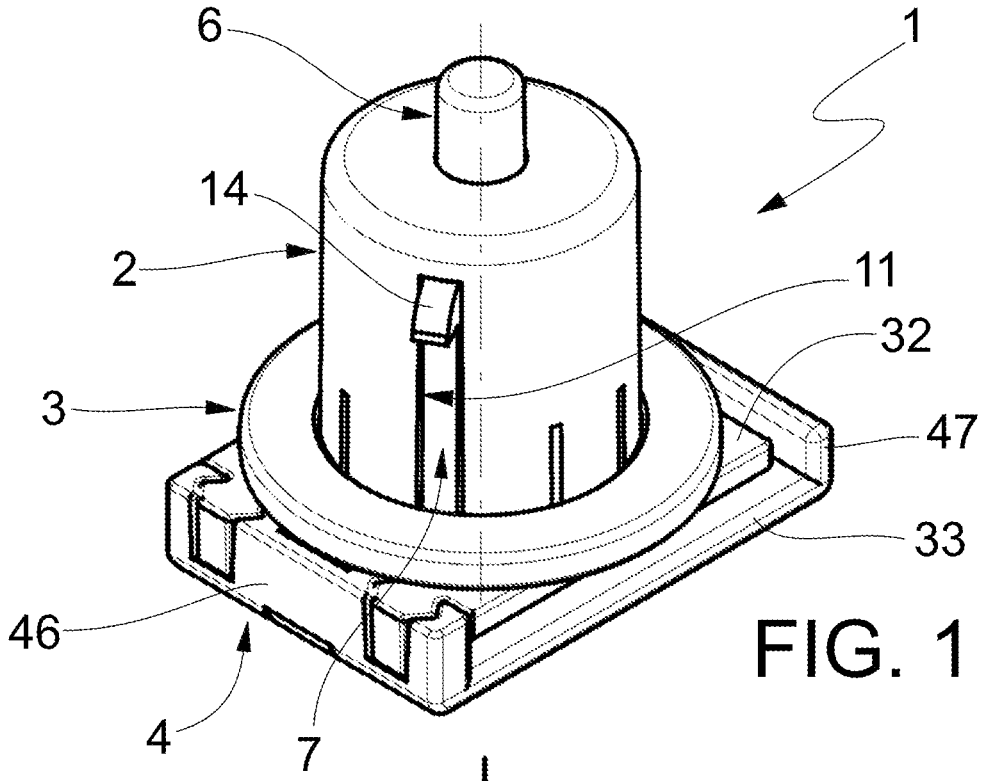
FIG. 1 is an axonometric view of the support according to the invention.

With reference to the annexed FIG. 1, 1 generally indicates a support for adhesive tape according to the present invention.

The support 1 comprises a cylindrical, or substantially cylindrical body 2.

The cylindrical body 2 is configured to be inserted inside the tubular core A of the adhesive tape N.

Figure 2:
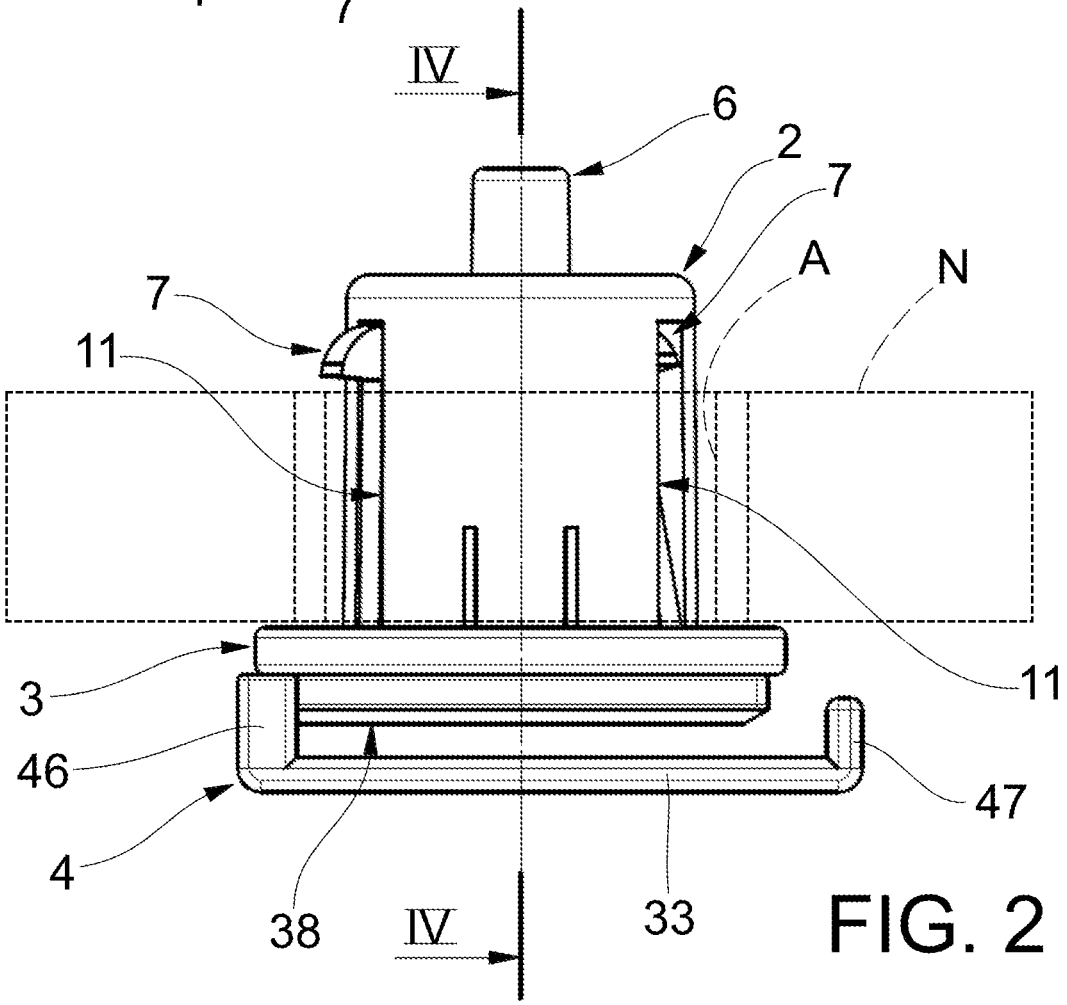
FIG. 2 is a side view of the support of FIG. 1, with an associated adhesive tape represented schematically and with a broken line.

The latter is represented schematically and with a broken line in FIG. 2, for the sole purpose of a better understanding.

The outside diameter of the cylindrical body 2 is sized so that it can be inserted comfortably (and therefore with sufficient clearance) inside the tubular core A of the adhesive tape N (the opening of which usually has standard dimensions).

The support 1 further comprises a base 3, associated with the cylindrical body 2.

According to an aspect of the invention, the support 1 comprises a connecting element 4; the connecting element 4 is associated with the base 3.

The connecting element 4 is configured to be connected, in a removable way, to an operator's garment, or to an operator's accessory, or to further parts of the operator's equipment, as better explained below.

According to another aspect of the invention, the cylindrical body 2 of the support 1 comprises selective constraint means 5 of the adhesive tape N.

The aforesaid selective constraint means 5 are provided with a control 6.

Said control 6 is suitable for actuating said selective constraint means 5 from a retention configuration of the adhesive tape N on the cylindrical body 2, to a configuration of free removal of the adhesive tape N from the cylindrical body 2, and vice versa.

The selective constraint means 5 comprise, in more detail, at least one retractable element 7.

The retractable element 7 is provided along the lateral surface of the cylindrical body 2.

In particular—see, for example, again the schematic representation of FIG. 2—when the tubular core A of the adhesive tape N is inserted along the cylindrical body 2, so that the adhesive tape N abuts against the surface of the base 3, the selective constraint means 5 are in a retention configuration of the adhesive tape N, and the at least one retractable element 7 (in particular, the one on the left in FIG. 2) is in a projecting position with respect to the lateral surface of the cylindrical body 2, so as to create an interference that prevents the tubular core A of the adhesive tape N from coming out of the aforementioned cylindrical body 2.

When, instead, the selective constraint means 5 are in the configuration of free extraction of the adhesive tape N, the at least one retractable element 7 (in particular, the one on the right in FIG. 2) is in a retracted position with respect to the lateral surface of the cylindrical body 2, and the aforementioned interference is thus removed; therefore, the adhesive tape N can be freely removed from the cylindrical body 2.

According to an aspect of the invention, the selective constraint means 5 comprise a plurality of retractable elements 7.

The retractable elements 7 are arranged to be angularly equidistant from each other, with reference to the axis of symmetry of the cylindrical body 2.

More in detail, in the specific embodiments represented in the attached figures, the selective constraint means 5 comprise three retractable elements 7.

The retractable elements 7 are identical to each other.

Figure 3:
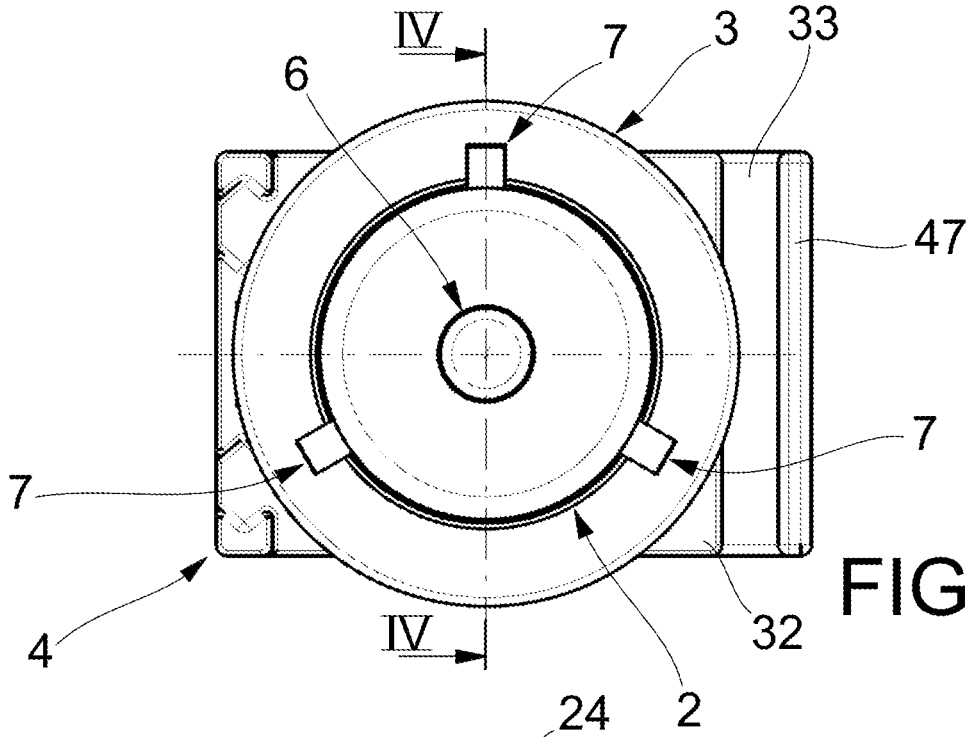
FIG. 3 is a top view of the support of FIGS. 1, 2.

The three retractable elements 7 are arranged to be angularly equidistant from each other at angles of 120°, with reference to the axis of symmetry of the cylindrical body 2 (FIG. 3).

In other possible embodiments of the invention, not shown in the figures, or according to other possible configurations, the number of retractable elements 7 of the selective constraint means 5 could be any number, and therefore different from three, in relation to the specific uses and/or constructive needs: consequently, their mutual positioning could also be different.

The cylindrical body 2 is internally hollow; it is open at one of its bases; in particular, at this base, an edge 8 of the cylindrical body 2 defines a (circular) opening 9.

The other base of the cylindrical body 2 comprises a central hole 10.

Furthermore, the cylindrical body 2 comprises at least one slot 11, oriented to be parallel, or substantially parallel, to the axis of symmetry of the cylindrical body 2. A respective retractable element 7 of the selective constraint means 5 is housed inside this slot 11; this retractable element 7 is movable between the respective protruding position and the respective retracted position, and vice versa, following the operator's actuation of the control 6, as better explained below.

More in detail, in the specific embodiment shown in the figures, which is of particular practical interest, the cylindrical body 2 comprises three slots 11, angularly equidistant at angles of 120° with respect to the axis of symmetry of the cylindrical body 2.

Inside these three slots 11 three respective retractable elements 7 are therefore housed, movable between the respective protruding positions and the respective retracted positions, and vice versa, with respect to the lateral surface of the cylindrical body 2.

According to an aspect of the invention, each retractable element 7 is articulated to the cylindrical body 2.

More in detail, each retractable element 7 is articulated to the edge 8 of the opening 9 of the cylindrical body 2.

Each retractable element 7 comprises an elongated body 12.

Two opposing and coaxial pins 13 emerge from one end of said elongated body 12. The pins 13 are configured to engage in respective semi-cylindrical seats 13*a* obtained in the aforementioned edge 8 of the opening 9 of the cylindrical body 2.

According to another aspect of the invention, each retractable element 7 comprises a respective tooth 14.

The tooth 14 is shaped by a first side of the elongated body 12.

Furthermore, each retractable element 7 comprises a respective first operating portion 15.

This first operating portion 15 is configured to cooperate with a respective second operating portion 16 provided in the control 6 of the selective constraint means 5. The first operating portion 15 comprises a profile 17, provided along a second side of the elongated body 12, opposite the first side in which the first tooth 14 is provided.

The profile 17 in turn comprises a first surface 18 and a second surface 19, connected to each other.

The first surface 18 and the second surface 19 of the profile 17 define an acute angle between them.

The elongated body 12 also comprises a terminal head 20, provided near the tooth 14.

The tooth 14 comprises a flat surface (in use, facing the base 3) and a rounded surface (e.g. a sort of cylindrical side surface portion).

According to another aspect of the invention, the control 6 of the selective constraint means 5 comprises a button 21.

The button 21 is, for example, cylindrical, or substantially cylindrical, but it could also have another shape.

The button 21 is slidably engaged in the hole 10 of the cylindrical body 2.

The cylindrical body 2 forms, at the hole 10, a tubular extension 22, which extends towards the inside of the cavity of the cylindrical body 2.

This tubular extension 22 allows to correctly guide the translation of the button 21 along the symmetry axis of the cylindrical body 2.

The second operating portion 16 is integral with the lateral surface of the button 21. In the event that the selective constraint means 5 comprise three retractable elements 7, the button 21 also comprises, correspondingly, three respective second operating portions 16 (angularly equidistant with respect to the axis of symmetry of the button 21).

Each second operating portion 16 is substantially sharp, or pointed; moreover, it is bent like a sort of hook.

In other words, each second operating portion 16 has a sort of tip 23 defined by two surfaces which form an acute angle between them.

Each tip 23 is configured to be inserted, selectively, between the first surface 18 and the second surface 19 of the profile 17 of the corresponding retractable element 7, as better described below.

The button 21 comprises a first end 24 for manual actuation, which in use is external to the cylindrical body 2 (i.e. it protrudes from the latter).

The button 21 also comprises a second end 25, opposite the first end 24, which in use is located inside the cavity of the cylindrical body 2.

The second operating portions 16 of the button 21 are located near this second end 25.

The base 3, associated with the cylindrical body 2, has a substantially discoidal shape.

On one of its faces (facing, in use, towards the cylindrical body 2), the base 3 comprises a central cylindrical raised part 26, and a peripheral raised part 27 (substantially in the shape of a circular crown).

Furthermore, the base 3 comprises windows 28, provided between the central raised part 26 and the peripheral raised part 27.

The windows 28 have a rectangular or substantially rectangular shape.

In particular, in the embodiment illustrated in the figures, the base 3 comprises three windows 28, angularly arranged to be equidistant by 120° with respect to the centre of the base 3 itself.

Correspondingly, the edge 8 of the opening 9 of the cylindrical body 2 forms elastically flexible tabs 29 (in particular, preferably three elastically flexible tabs 29), angularly equidistant from each other (by 120°) and offset with respect to the slots 11.

The tabs 29 are configured to snap-fit elastically into the corresponding windows 28 of the base 3, so as to provide a removable connection between the two parts. According to another aspect of the invention, the selective constraint means 5 comprise an elastic element 30 configured to adjust the translation of the button 21 from an inactive position to an active position, and vice versa.

More in detail, the elastic element 30 is configured to keep the button 21 in the aforementioned inactive position.

Figure 4:
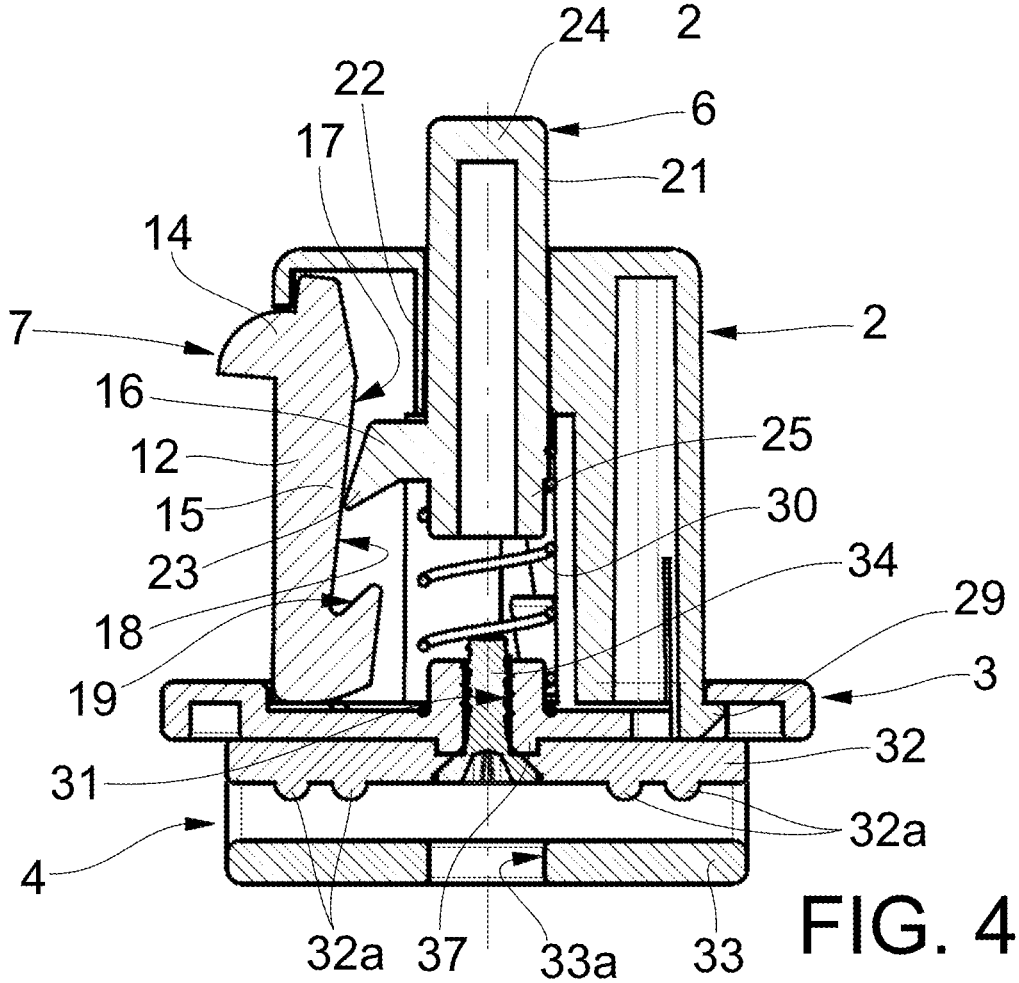
FIG. 4 is a diametrical section of support, along the plane IV-IV of FIGS. 2, 3.
Figure 5:
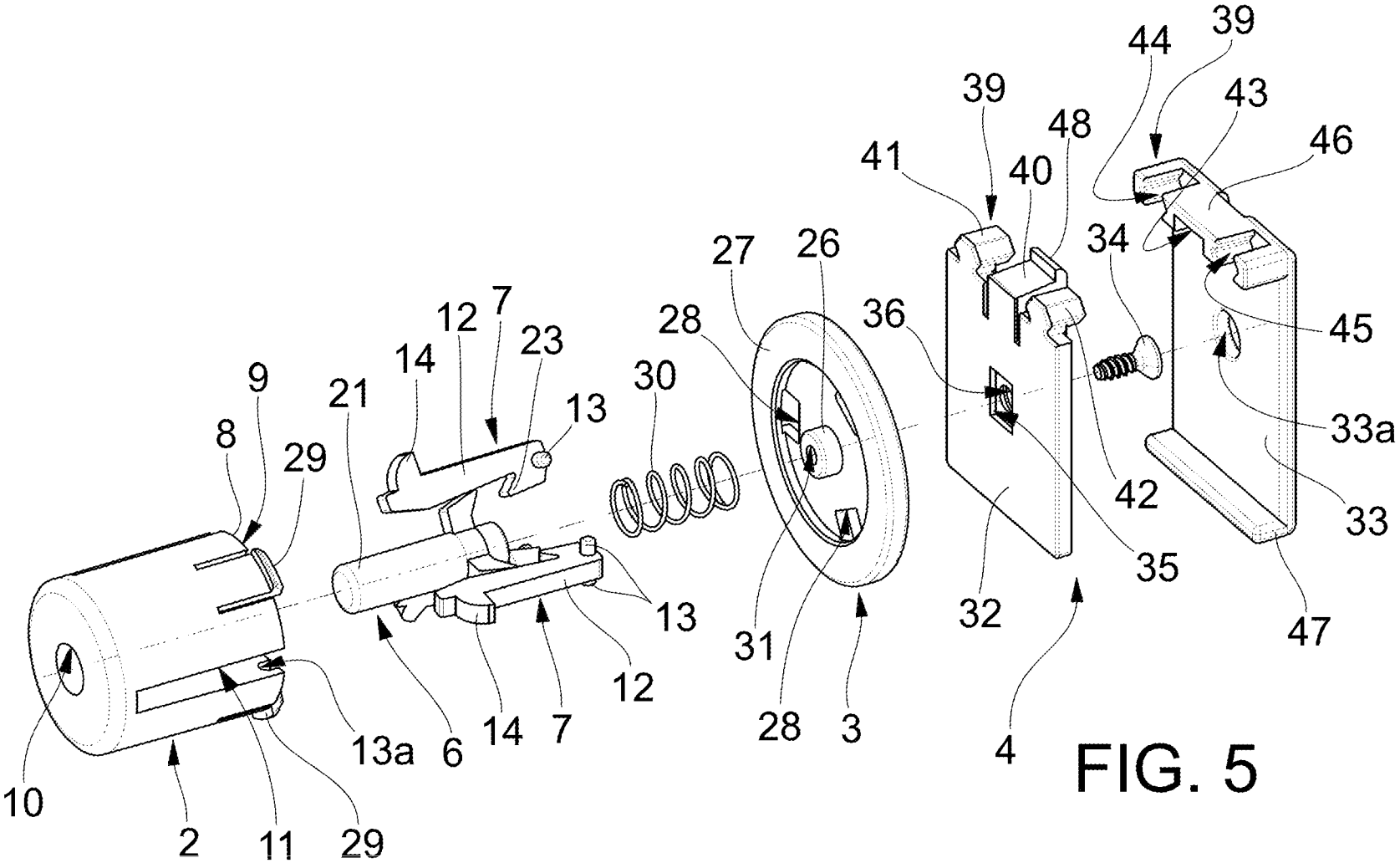
FIG. 5 is an exploded axonometric view of the support of FIGS. 1-4.
Figure 6:
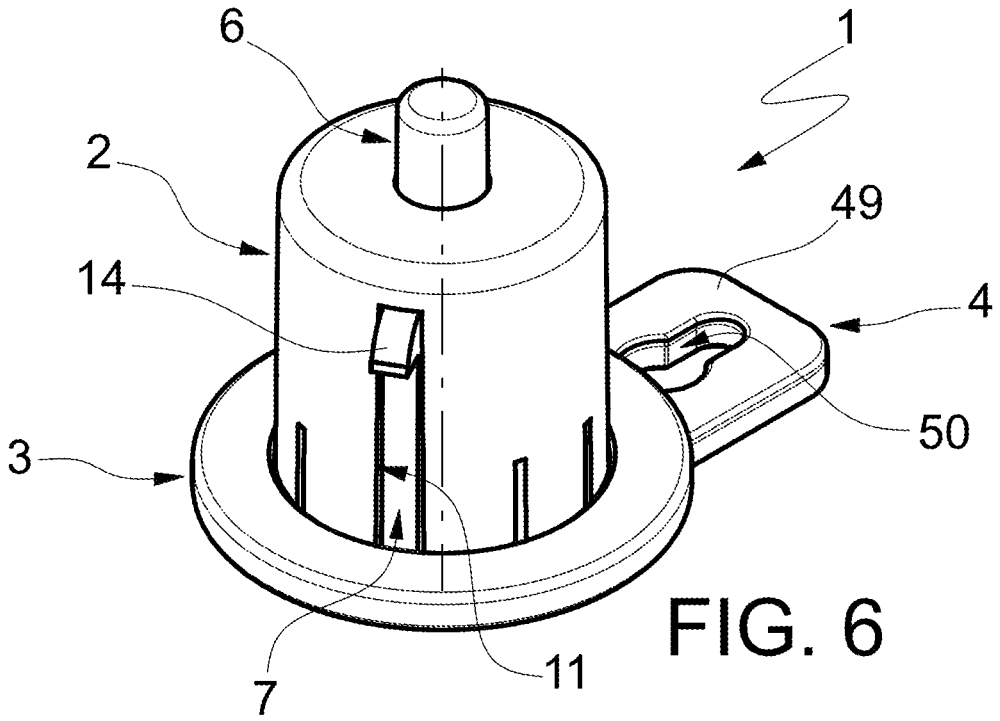
FIG. 6 is an axonometric view of the support, according to another embodiment of the invention.
Figure 7:
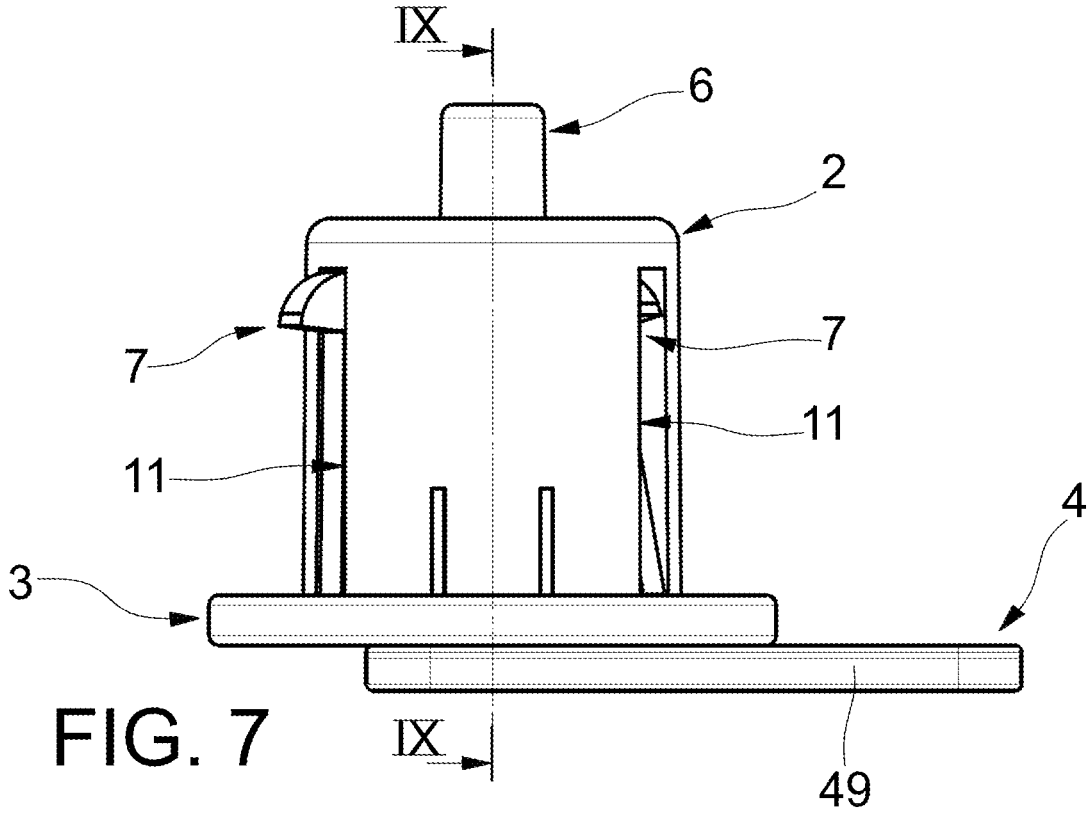
FIG. 7 is a side view of the support of FIG. 6.
Figure 8:
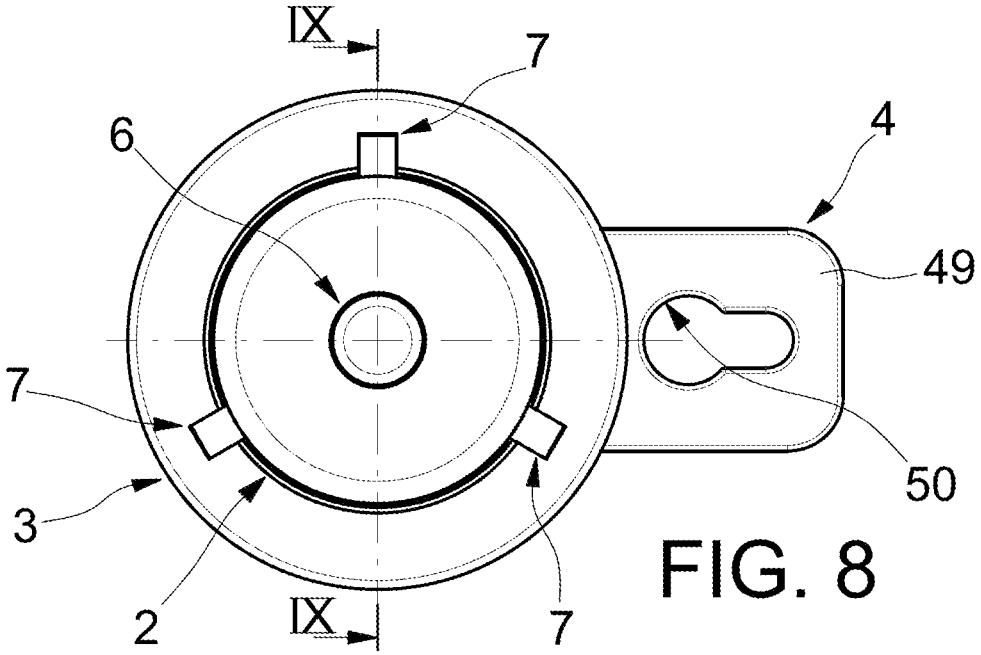
FIG. 8 is a top view of the support of FIGS. 6, 7.
Figure 9:
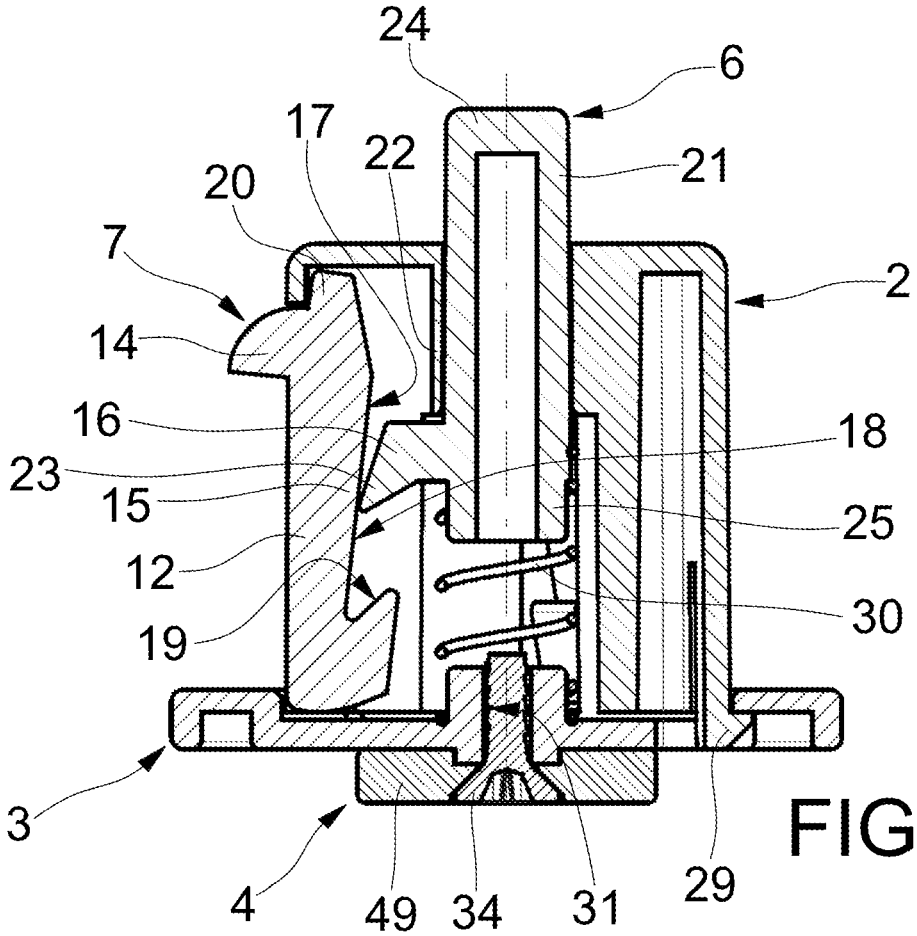
FIG. 9 is a diametrical section of support, along the plane IX-IX of FIGS. 6, 7.
Figure 10:
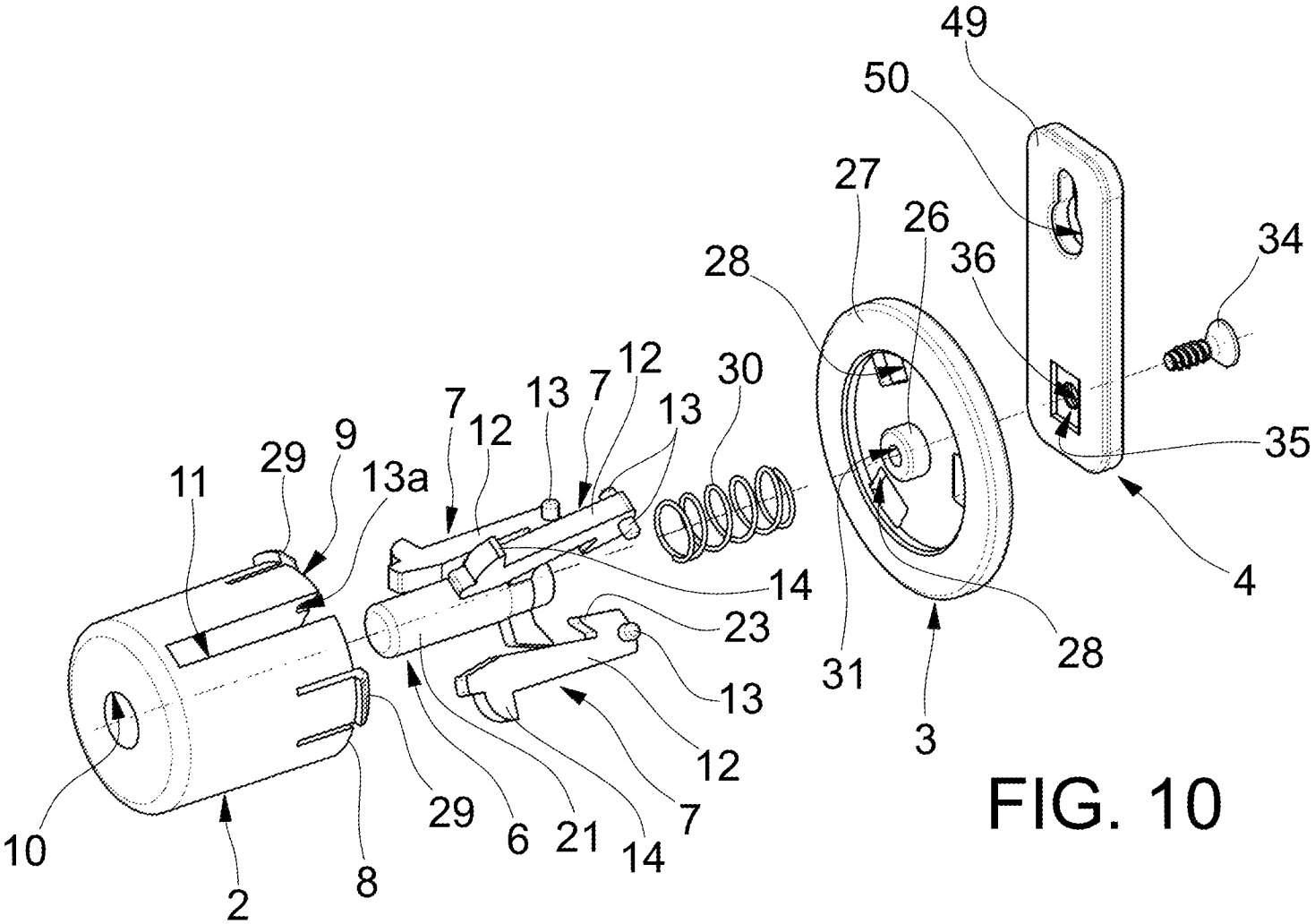
FIG. 10 is an exploded axonometric view of the support according to the embodiment of FIGS. 6-9.

In this inactive position, shown in particular in the cross-section of FIG. 4, the button 21 partially protrudes from the cylindrical body 2, while each second operating portion 16 of the button 21 abuts against the respective first surface 18 of the profile 17 of the corresponding retractable element 7.

In this configuration of the selective constraint means 5, therefore, each retractable element 7 is maintained in its respective projecting position, with respect to the lateral surface of the cylindrical body 2, by the action of the elastic element 30.

The further outstroke of each retractable element 7 from the respective slot 11 is prevented by the terminal head 20, which abuts against the inside surface of the cylindrical body 2.

In this configuration, therefore, the adhesive tape N—if present—is held on the cylindrical body 2 of the support 1, and its extraction is prevented by the protruding position of the retractable elements 7.

The elastic element 30 is interposed between the second end 25 of the button 21 and the central raised part 26 of the base 3.

The elastic element 30 can comprise, for example, a cylindrical helical spring. In this case, the end coils of this helical spring are inserted on the second end 25 of the button 21 and on the central raised part 26 of the base 3—respectively.

The central raised part 26 of the base 3 comprises a central threaded through hole 31, the function of which will be clarified further below.

In the embodiment of the support 1 illustrated in FIGS. 1-5, the connecting element 4 is configured to associate the support 1 with an accessory of the operator. In particular, in an embodiment of the invention of particular practical interest, the connecting element 4 is configured to associate the support 1 with the operator's belt.

More in detail, the connecting element 4 comprises a first plate 32 and a second plate 33, associated with each other.

The first plate 32 is rigidly connected to the base 3.

In a preferred embodiment of the invention, the first plate 32 is connected to the base 3 by means of a screw 34, engaged in the threaded hole 31 of the base 3.

To prevent any relative rotation between the base 3 and the first plate 32 of the connecting element 4, the first plate 32 comprises a recess 35 of quadrangular shape or cross-section (for example square, rectangular, etc.), in the centre of which a passage hole 36 is provided for the screw 34.

A corresponding raised portion 37, shaped by the base 3, and having a shape complementary to that of the recess 35, engages in such recess 35 (on the opposite face with respect to that in which the central raised part 26 is provided).

The first plate 32 and the second plate 33 are connected to each other so as to define, between them, a compartment 38, or interspace.

The compartment 38 is configured—particularly, but not exclusively—to accommodate the operator's belt, so as to constrain the support 1 to the belt.

The internal surface of the first plate 32 can comprise some sort of raised ribs 32*a*, which have the function of increasing the friction with the belt housed in the compartment 38, improving its hold.

The second plate 33 can comprise a hole 33*a* for accessing the screw 34.

In some embodiments of the invention, the first plate 32 and the second plate 33 could be made in a single piece, without therefore being separable one from the other. However, in the embodiment illustrated in the figures, which is of particular practical interest, the first plate 32 and the second plate 33 are mutually coupled by means of an interlocking connection 39.

According to an aspect of the invention, this interlocking connection 39, while ensuring the rigid connection between the first and second plates 32, 33, is also suitable for allowing the separation of the aforementioned plates 32, 33 in the case in which the support 1, together with the adhesive tape N, suffers an accidental impact (e.g., but not limited to, a side impact).

This precaution constitutes a safety measure for the operator, since it prevents the adhesive tape A, associated with the support 1, from becoming entangled/caught somewhere during work: if this occurs, the impact suffered by the adhesive tape N causes the immediate separation of the two plates 32, 33.

More particularly, the interlocking connection 39 comprises a plurality of appendages 40, 41, 42 shaped on one of the sides, or lateral edges, of the first plate 32.

Furthermore, correspondingly, the interlocking connection 39 comprises a plurality of seats 43, 44, 45 shaped on one of the sides, or lateral edges, of the second plate 33; the aforementioned appendages 40, 41, 42 of the first plate 32 are intended to engage into these seats 43, 44, 45.

In greater detail, the first plate 32 comprises a first appendage 40; the latter is substantially provided at the centre line of one of the sides, or lateral edges, of the first plate 32.

Furthermore, the first plate 32 comprises a second appendage 41 and a third appendage 42.

The second appendage 41 and the third appendage 42 are arranged on the two sides of the first appendage 40.

Correspondingly, the second plate 33 comprises a first seat 43; the first seat 43 is substantially provided at the centre of one of the sides, or lateral edges, of the first plate 33.

Furthermore, the second plate 33 comprises a second seat 44 and a third seat 45. The second seat 44 and the third seat 45 are arranged on the two sides of the first seat 43.

The second plate 33 comprises, in more detail, a first edge 46 and a second edge 47, provided along respective opposite sides of the second plate 33.

In particular, the seats 43, 44, 45 of the second plate 33 are made in the thickness of the first edge 46.

The first seat 43 is made passing through the thickness of the first edge 46 of the second plate 33.

The first appendage 40 comprises a terminal tooth 48, configured to snap abut on a corresponding surface adjacent to the opening of the first seat 43.

The cross-sections of the second seat 44 and of the third seat 45 are complementary to the cross sections of the second appendage 41 and of the third appendage 42—respectively.

In the embodiment illustrated in the figures, the second, third seat 44, 45 and the second, third appendage 41, 42, can have the same substantially polygonal cross section (for example hexagonal, or of another shape).

The mutual constraint between the first plate 32 and the second plate 33 is determined, in particular, by the abutment of the terminal tooth 48 of the first appendage 40 on the surface adjacent to the opening of the first seat 43; consequently, any accidental impact suffered by the adhesive tape N, or by the cylindrical body 2, in the lateral direction, determines the immediate release of the first plate 32 and the second plate 33, thus avoiding creating annoying or dangerous situations for the operator.

As can be understood by observing, in particular, FIG. 2—if the connecting element 4 is associated with the operator's belt—the second edge 47 of the second plate 33 allows the belt to be held inside the compartment 38; in other words, the second edge 47 prevents the belt from accidentally coming out of the compartment 38.

The way of use of the support 1 according to the invention is, in the light of what has been described, entirely intuitive.

The support 1 is normally in the configuration illustrated in FIG. 4, wherein each second operating portion 16 of the button 21 abuts on the respective first surface 18 of the respective retractable element 7.

In other words, each retractable element 7 is forced to remain in its respective protruding position with respect to the external surface of the cylindrical body 2.

To constrain the adhesive tape N to the support 1, the operator acts on the button 21, in particular by pressing its first end 24.

The button 21, therefore, moves towards the base 3, opposed by the elastic element 30.

In doing so, each second operating portion 16 of the button 21 becomes separated from the second surface 18 of the profile 17 of each retractable element 7, until coming into contact with the first surface 19.

In this lowered configuration of the button 21, each retractable element 7 is free to rotate around the axis of the respective pins 13, so as to move into the respective retracted position (i.e. inside the cavity of the cylindrical body 2).

Therefore, the operator, holding the button 21 down, inserts the adhesive tape N along the cylindrical body 2, until the tubular core A comes into contact with the rounded surfaces of the teeth 14.

By further pressing the adhesive tape N in the inserting direction, the retractable elements 7 rotate towards the inside of the cylindrical body 2, towards their respective retracted positions.

In this way, the tubular core A of the adhesive tape N is free to slide along the cylindrical body 2, until it comes into contact with the base 3.

At this point, the operator can release the button 21, which returns to the initial position of FIG. 4 through the action of the elastic element 30; in this position, the teeth 14 of the retractable elements 7 (locked in their respective protruding positions) prevent the adhesive tape N from slipping off the cylindrical body 2.

To remove the adhesive tape N from the support 1, the operator proceeds by carrying out the previously described operations again, i.e. pressing the button 21, so that the translation of the latter allows the free rotation of the retractable elements 7 towards the inside of the cylindrical body 2.

The simple pull exerted on the adhesive tape N, in the direction of extraction from the cylindrical body 2, causes the retractable elements 7 to return to their respective retracted positions, so that the adhesive tape N can be freely removed (since there is no interference from the teeth 14).

As can be understood, the operations described for inserting/extracting the adhesive tape N are simple, easy and quick to carry out, possibly even with just one hand.

Another embodiment of the support 1 according to the invention is shown in FIGS. 6-10.

This further embodiment differs from the previous one, illustrated in FIGS. 1-5, in the shaping of the connecting element 4.

In this embodiment, the connecting element 4 comprises a plate 49 (e.g. of rectangular shape, or other suitable shape), provided with at least one slot 50 for fixing the support 1 to any wall or surface (e.g. the surface of a toolbox, a case, or even specific parts of the operator's clothing, without limitations).

The shaping of the plate 49, in its connection part to the base 3, is essentially identical to that of the first plate 32 described in connection with the embodiment of FIGS. 1-5, i.e. it comprises a recess 35 with a quadrangular (e.g. square, rectangular, etc.) shape or section.

The slot 50 can consist of two circular portions having different diameters, joined and connected together, e.g. for the purpose of inserting inside it an element suitable to hold the support, provided with a head and a stem (e.g. a nail, a screw, a stud, or the like).

All the parts and components of the support 1 previously described can be made of a polymeric material with suitable mechanical characteristics, or also of other types of material, without any particular limitations.

This invention thus conceived allows to obtain important technical advantages.

Thanks to the support solution 1 according to the invention, the operator can keep the adhesive tape N, in a safe and reliable way, in the most convenient and handy location for them.

According to a preferred, albeit non-exclusive, version of the invention, the support 1 is conveniently and easily fixed to the operator's belt, therefore in a position reachable with their hands in a simple and immediate way.

Thanks to the solution according to the present invention, the working conditions of the operator are considerably improved and made more comfortable, since the risk of losing the adhesive tape, or of confusing the adhesive tape sought at a given time with others of a similar type is reduced or eliminated.

It has thus been seen how the invention achieves the intended purposes.

The present invention has been described according to preferred embodiments, but equivalent variants can still be conceived without departing from the scope of the appended claims.

The invention claimed is:

1. A support for adhesive tape, comprising:

a cylindrical, or substantially cylindrical, body configured to be inserted inside a tubular core of the adhesive tape, a base, associated with said cylindrical body, to which, in turn, a connecting element to an operator's garment, or to an operator's accessory, or to further parts of the operator's equipment, is associated;

at least one retractable element, provided along a lateral surface of said cylindrical body, comprising a control suitable for selectively actuating said retractable element from a retention configuration of the adhesive tape on the cylindrical body, to a configuration of free removal of the adhesive tape from the cylindrical body, and vice versa, wherein said control comprises a button, slidingly engaged in a hole of said cylindrical body.

2. The support according to claim 1, wherein when said retractable element is in said adhesive tape retention configuration, it is in a projecting position with respect to the lateral surface of said cylindrical body, so as to create an interference which prevents the tubular core of the adhesive tape from coming out of said cylindrical body, and wherein when said retractable element is in said configuration of free removal of the adhesive tape, it is in a retracted position with respect to the lateral surface of said cylindrical body, so that said interference is removed.

3. The support according to claim 2, comprising a plurality of said retractable elements, angularly equidistant from each other with reference to a central axis of said cylindrical body.

4. The support according to claim 2, wherein said at least one retractable element is articulated to said cylindrical body, and it comprises a first operating portion configured to cooperate with a respective second operating portion provided in said control.

5. The support according to claim 1, comprising an elastic element, configured to adjust translation of said button between an inactive position and an active position, and vice versa, said elastic element being configured to keep said button in said inactive position.

6. The support according to claim 1, wherein said cylindrical body is internally hollow and comprises at least one slot oriented in parallel, or substantially parallel, direction to a central axis of said cylindrical body, said at least one retractable element being housed inside said slot.

7. The support according to claim 1, wherein said connecting element is configured to associate the support with an operator's belt, and comprises a first plate and a second plate associated one to the other, so as to define between them a compartment configured to accommodate said belt.

8. The support according to claim 7, wherein said first plate and second plate are mutually coupled by means of an interlocking connection suitable for allowing separation between said plates in the case in which the support, together with the adhesive tape, suffers an accidental impact.

* * * * *